US011017729B2

(12) United States Patent
Kim et al.

(10) Patent No.: US 11,017,729 B2
(45) Date of Patent: May 25, 2021

(54) DISPLAY DEVICE AND METHOD OF DRIVING THE SAME

(71) Applicant: SAMSUNG DISPLAY CO., LTD., Yongin-si (KR)

(72) Inventors: Kyun Ho Kim, Yongin-si (KR); Sung In Kang, Yongin-si (KR); Ki Hyun Pyun, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/731,674

(22) Filed: Dec. 31, 2019

(65) Prior Publication Data

US 2020/0265788 A1 Aug. 20, 2020

(30) Foreign Application Priority Data

Feb. 15, 2019 (KR) ..... 10-2019-0017855

(51) Int. Cl.
*G09G 3/32* (2016.01)
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2310/027* (2013.01); *G09G 2320/0233* (2013.01); *G09G 2320/0276* (2013.01)

(58) Field of Classification Search
CPC ..... G09G 2300/043; G09G 2310/027; G09G 2320/0233; G09G 2320/0276; G09G 2320/0295; G09G 2320/045; G09G 3/2003; G09G 3/3233; G09G 3/3291
USPC ..... 345/63, 88, 77, 87–89, 207–211, 589, 345/690–691
See application file for complete search history.

(56) References Cited

U.S. PATENT DOCUMENTS 7,773,059 B2 8/2010 Jeon et al.
2003/0222839 A1* 12/2003 Lee ..... G09G 3/3648 345/88
2004/0061709 A1* 4/2004 Park ..... G09G 3/2033 345/690
2007/0080905 A1* 4/2007 Takahara ..... G09G 3/3258 345/76

(Continued)

FOREIGN PATENT DOCUMENTS

JP 2010-286783 12/2010
KR 10-1142281 5/2012

(Continued)

*Primary Examiner* — Tony O Davis
(74) *Attorney, Agent, or Firm* — F. Chau & Associates, LLC

(57) ABSTRACT

A display device includes: a display panel including a plurality of pixels; a first correction circuit configured to perform, using a gamma correction value, a gamma correction for first image data; a second correction circuit configured to receive the gamma-corrected first image, and to generate second image data by performing gray-scale compensation for the gamma-corrected first image data; and a data driver configured to provide a data signal corresponding to the second image data to the plurality of pixels, wherein the second correction circuit performs the gray-scale compensation based on the gamma correction value and a threshold value measured for each of the plurality of pixels.

18 Claims, 4 Drawing Sheets

(56) References Cited

U.S. PATENT DOCUMENTS

| | | | | |
|---|---|---|---|---|
| 2007/0103416 | A1* | 5/2007 | Kim | G09G 3/3611 345/88 |
| 2008/0122813 | A1* | 5/2008 | Kim | G09G 3/3648 345/204 |
| 2008/0136763 | A1* | 6/2008 | Ohashi | H04N 5/202 345/89 |
| 2009/0153592 | A1* | 6/2009 | Choi | G09G 5/04 345/690 |
| 2009/0295688 | A1* | 12/2009 | Song | G09G 3/2803 345/63 |
| 2013/0135334 | A1* | 5/2013 | Ohwaki | G09G 3/3406 345/589 |
| 2013/0241970 | A1* | 9/2013 | Lee | G09G 3/3406 345/690 |
| 2015/0194104 | A1* | 7/2015 | Lee | G09G 3/3607 345/691 |
| 2017/0287120 | A1* | 10/2017 | Sato | G06T 5/007 |
| 2018/0040109 | A1* | 2/2018 | Hayashi | G02B 5/208 |
| 2018/0059465 | A1* | 3/2018 | Koudo | G02F 1/13471 |
| 2018/0070020 | A1* | 3/2018 | Rotte | H04N 5/2351 |
| 2018/0130437 | A1* | 5/2018 | Park | G09G 3/2092 |
| 2019/0130844 | A1* | 5/2019 | Yang | G09G 3/2007 |
| 2019/0341003 | A1* | 11/2019 | Inamura | G09G 5/10 |
| 2019/0362671 | A1* | 11/2019 | Kuki | G09G 3/3233 |
| 2020/0265769 | A1* | 8/2020 | Pyo | G09G 3/2003 |

FOREIGN PATENT DOCUMENTS

| | | |
|---|---|---|
| KR | 10-2014-0076061 | 6/2014 |
| KR | 10-1894326 | 8/2018 |

* cited by examiner

DISPLAY DEVICE AND METHOD OF DRIVING THE SAME

CROSS-REFERENCE TO RELATED APPLICATION

The present application claims priority under 35 U.S.C. § 119 to Korean Patent Application No. 10-2019-0017855, filed on Feb. 15, 2019, the disclosure of which is incorporated by reference herein in its entirety.

TECHNICAL FIELD

Exemplary embodiments of the present inventive concept relate to a display device and a method of driving the same, and more particularly, to a display device including a first compensation circuit and second compensation circuit and to a method of driving the display device.

DISCUSSION OF THE RELATED ART

Generally, a display device includes a display panel and a display panel driver. The display panel includes scan lines, data lines, and pixels. The display panel driver includes a controller, a scan driver, and a data driver.

Each of the pixels typically includes a plurality of transistors, a storage capacitor, and an organic light emitting element. If a difference in luminance between pixels of the display device occurs due to distributions of the threshold voltages of the transistors, a spot may become visible on the display panel to a user who uses the display device. To prevent a spot from being visible to a user, a threshold voltage compensation for an image signal may be used.

Recently, as the resolutions of display devices are increased, to reduce the time it takes to perform the threshold voltage compensation, a compensation value is determined only for one of red, green or blue colors, and the same compensation value is uniformly applied to the other colors. However, this conventional scheme may not accurately control the gray scale to a predetermined value.

SUMMARY

According to an exemplary embodiment of the present inventive concept, a display device includes: a display panel including a plurality of pixels; a first correction circuit configured to perform, using a gamma correction value, a gamma correction for first image data; a second correction circuit configured to receive the gamma-corrected first image, and to generate second image data by performing gray-scale compensation for the gamma-corrected first image data; and a data driver configured to provide a data signal corresponding to the second image data to the plurality of pixels, wherein the second correction circuit performs the gray-scale compensation based on the gamma correction value and a threshold value measured for each of the plurality of pixels.

In an exemplary embodiment of the present inventive concept, the gamma correction value corresponds to the first image data, and wherein the first correction circuit obtains the gamma correction value from a memory, and performs the gamma correction by applying the gamma correction value to the first image data.

In an exemplary embodiment of the present inventive concept, the second correction circuit determines a gray-scale compensation level for the first image data based on the measured threshold value, determines a gray-scale compensation value for the first image data by applying the gamma correction value to the determined gray-scale compensation level, and generates the second image data by applying the determined gray-scale compensation value to the gamma-corrected first image data.

In an exemplary embodiment of the present inventive concept, the second correction circuit determines the gray-scale compensation level based on the measured threshold value of a pixel that corresponds to a first color, and determines the determined gray-scale compensation level to be a gray-scale compensation value of image data for the first color.

In an exemplary embodiment of the present inventive concept, the gamma correction value includes a gamma correction value of the first color and a gamma correction value of a second color, wherein the second correction circuit determines a ratio of the gamma correction value of the second color to the gamma correction value of the first color, and determines a gray-scale compensation value of the second color by applying the determined ratio to the gray-scaly compensation level.

In an exemplary embodiment of the present inventive concept, the first correction circuit obtains the gamma correction value from a pre-stored look-up table.

In an exemplary embodiment of the present inventive concept, the threshold value includes a threshold voltage, and the second compensation circuit determines a gray-scale compensation level for the first image data in response to a threshold voltage of a first pixel of the plurality of pixels to determine a gray-scale compensation value for the first image data, wherein the second image data is generated based on the gray-scale compensation value for the first image.

According to an exemplary embodiment of the present inventive concept, a method of driving a display device including a plurality of pixels includes: performing, using a gamma correction value, a gamma correction for first image data; generating second image data by performing gray-scale compensation for the gamma-corrected first image data; and outputting an image corresponding to the second image data, wherein the generating of the second image data includes: determining a gray-scale compensation value based on the gamma correction value and a threshold voltage measured for each of the plurality of pixels; and generating the second image data by applying the gray-scale compensation value to the gamma-corrected first image data.

In an exemplary embodiment of the present inventive concept, the performing of the gamma-correction for the first image data includes: obtaining the gamma correction value from a memory, wherein the gamma correction value corresponds to the first image data; and applying the gamma-correction value to the first image data.

In an exemplary embodiment of the present inventive concept, the generating of the second image data includes: determining a gray-scale compensation level for the first image data based on the measured threshold voltage; determining the gray-scale compensation value for the first image data by applying the gamma correction value to the determined gray-scale compensation level; and generating the second image data by applying the determined gray-scale compensation value to the gamma-corrected first image data.

In an exemplary embodiment of the present inventive concept, wherein the determining of the gray-scale compensation level includes determining the gray-scale compensation level based on the measured threshold voltage of a pixel that corresponds to a first color, and wherein the determining of the gray-scale compensation value includes determining the determined gray-scale compensation level to be a gray-scale compensation value of image data for the first color.

In an exemplary embodiment of the present inventive concept, the gamma correction value includes a gamma correction value of the first color and a gamma correction value of a second color, and wherein the determining of the gray-scale compensation value includes: determining a ratio of the gamma correction value of the second color to the gamma correction value of the first color; and determining a gray-scale compensation value for the second color by applying the determined ratio to the gray-scale compensation level.

In an exemplary embodiment of the present inventive concept, the obtaining of the pre-stored gamma correction value includes loading the gamma correction value corresponding to the first image data from a pre-stored look-up table.

In an exemplary embodiment of the present inventive concept, the determining of the gray-scale compensation level includes determining the gray-scale compensation level based on a change between a reference threshold voltage of a pixel and the measured threshold voltage of the pixel.

According to an exemplary embodiment of the present inventive concept, a display device includes: a display panel including a plurality of pixels; a first correction circuit configured to perform, using a gamma correction value, a gamma correction for first image data; a second correction circuit configured to receive the gamma-corrected first image, and to generate second image data by applying a gray-scale compensation value, for the first image data, to the gamma-corrected first image, wherein the gray-scale compensation value is determined by applying a gamma correction value, corresponding to the first image data, to a gray-scale compensation level for the first image data; and a data driver configured to provide a data signal corresponding to the second image data to the plurality of pixels.

In an exemplary embodiment of the present inventive concept, the second correction circuit determines the gray-scale compensation level for the first image data in response to a measured threshold voltage of a first pixel of the plurality of pixels.

In an exemplary embodiment of the present inventive concept, the gray-scale compensation level for the first image data is determined based on a change between a reference threshold voltage of the first pixel and the measured threshold voltage of the first pixel.

In an exemplary embodiment of the present inventive concept, the first pixel corresponds to a first color, wherein the gamma correction value includes a gamma correction value of the first color and a gamma correction value of a second color, and wherein the second correction circuit determines the determined gray-scale compensation level for the first image data to be a gray-scale compensation value of the first image data for the first color, and determines a gray-scale compensation value for the second color by applying a predetermined ratio to the gray-scale compensation level for the first image data, wherein the predetermined ratio is of the gamma correction value of the second color to the gamma correction value for the first color.

In an exemplary embodiment of the present inventive concept, the gamma correction value corresponds to the first image data and is obtained from a memory.

In an exemplary embodiment of the present inventive concept, the first image data is received from an external circuit.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EXEMPLARY EMBODIMENTS

Figure 1:
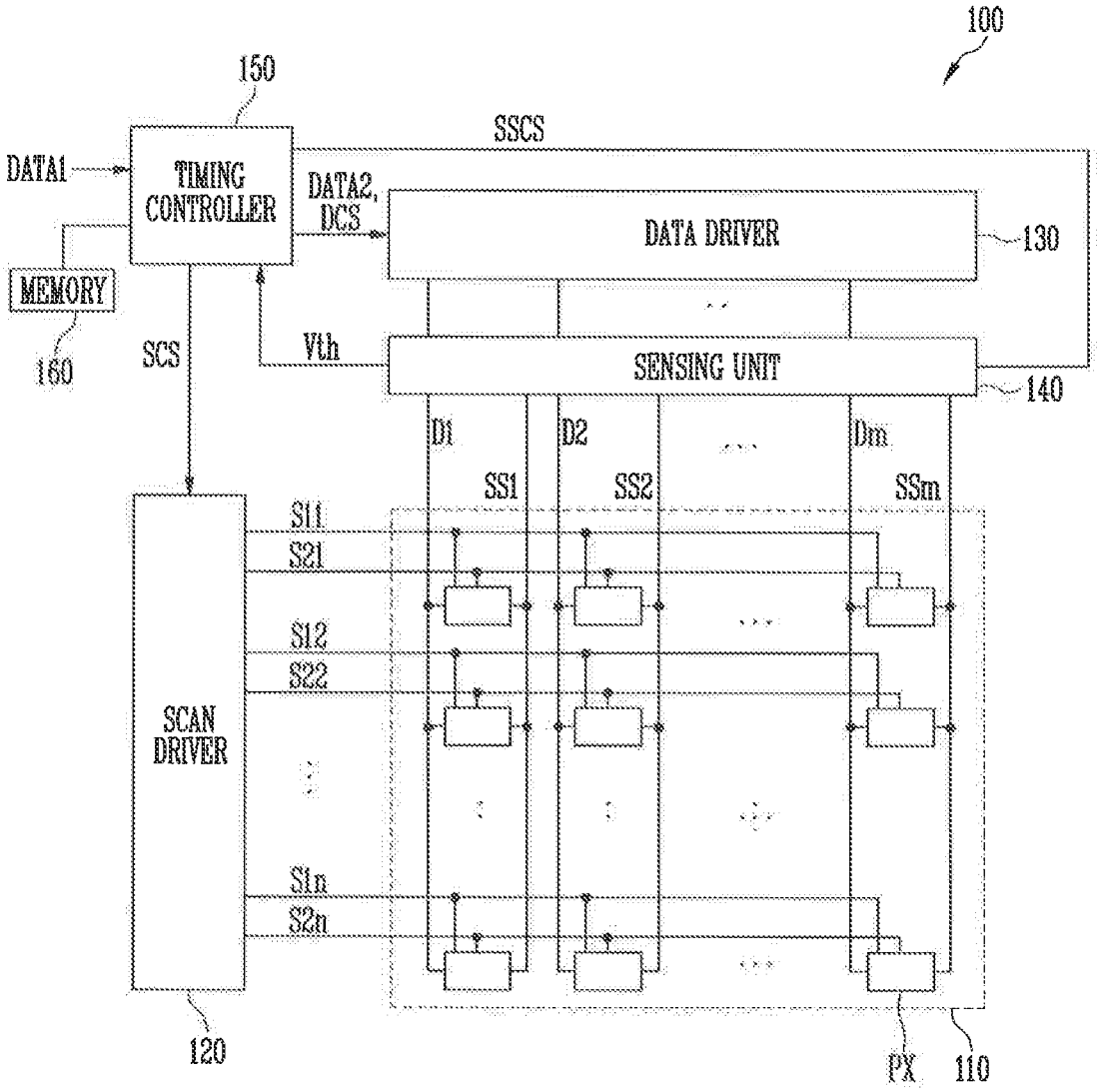
FIG. 1 is a block diagram illustrating a display device in accordance with an exemplary embodiment of the present inventive concept.

Exemplary embodiments of the present inventive concept provide a display device for initializing a threshold voltage characteristic of a driving transistor by applying an on-bias voltage to the driving transistor during a vertical blank period, and a driving method of the display device.

In the specification, when an element is referred to as being "connected" or "coupled" to another element, the element can be directly connected or coupled to the other element or to one or more intervening elements interposed therebetween.

Exemplary embodiments of the inventive concept will be described more fully hereinafter with reference to the accompanying drawings. It is to be understood that like reference numerals may refer to like elements throughout this disclosure, and thus, repetitive descriptions may be omitted.

FIG. 1 is a block diagram illustrating a display device 100 in accordance with an exemplary embodiment of the present inventive concept.

Referring to FIG. 1, the display device 100 in accordance with an exemplary embodiment of the present inventive concept may include a display panel 110, a scan driver 120, a data driver 130, a sensing unit 140, a timing controller 150, and a memory 160. The display device 100 may be a device configured to output an image based on image data (e.g., first image data DATA1) provided from an external device. For example, the display device 100 may be an organic light emitting display device. However, the present inventive concept is not limited thereto. For example, the display device 100 may be a liquid crystal display device.

The display panel 110 may include a plurality of first scan lines S11 to S1*n*, a plurality of second scan lines S21 to S2*n*, a plurality of data lines D1 to Dm, a plurality of sensing lines SS1 to SSm, and a plurality of pixels PX (or sub-pixels). Here, n and m each may be an integer of 2 or more.

The pixels PX may be disposed at intersections between the first scan lines S11 to S1*n*, the second scan lines S21 to S2*n*, the data lines D1 to Dm, and the sensing lines SS1 to SSm.

Each of the pixels PX may emit light based on a first scan signal supplied through a corresponding one of the first scan lines S11 to S1*n*, a second scan signal supplied through a corresponding one of the second scan lines S21 to S2*n*, and a data signal supplied through a corresponding one of the data lines D1 to Dm. The configuration of the pixel PX will be described in with reference to FIG. 2 according to an exemplary embodiment of the present inventive concept.

The scan driver 120 may generate first scan signals and second scan signals based on a scan driving control signal SCS. For example, the scan driver 120 may supply the first scan signals to the pixels PX through the first scan lines S11 to S1*n* during a display period, and may supply the second scan signals to the pixels PX through the second scan lines S21 to S2*n* during a sensing period for sensing characteristics of the pixels PX.

The scan driving control signal SCS may be provided from the timing controller 150 to the scan driver 120. The scan driver control signal SCS may include a start pulse and clock signals. The scan driver 120 may include a shift register configured to sequentially generate scan signals in response to the start pulse and the clock signals.

The data driver 130 may generate data signals, based on a data driving control signal DCS and image data (e.g., second image data DATA2). The data driver 130 may provide, to the display panel 110, data signals generated in response to the data driving control signal DCS during a display period in a frame. For example, the data driver 130 may supply data signals to the pixels PX through the data lines D1 to Dm. The data driving control signal DCS may be provided from the timing controller 150 to the data driver 130.

The sensing unit 140 may be coupled to the sensing lines SS1 to SSm and measure (or, e.g., detect or sense) characteristics of each pixel PX based on a sensing control signal SSCS. The characteristics of each pixel PX may be characteristics of a driving transistor provided in the pixel PX. For example, the characteristics may include a threshold voltage Vth, mobility, etc. of the driving transistor. In an exemplary embodiment of the present inventive concept, the characteristics of each pixel PX may be characteristics of a light emitting element provided in the pixel PX. The sensing unit 140 may transmit measured characteristic information, e.g., the threshold voltage Vth, of each pixel PX to the timing controller 150.

In an exemplary embodiment of the present inventive concept, the data driver 130 may apply a sensing voltage to a specific data line (e.g., the m-th data line Dm) in response to a sensing control signal SSCS during a sensing period. The sensing unit 140 may measure characteristics of each pixel PX based on current or voltage transmitted through the corresponding sensing line (e.g., the m-th sensing line SSm) to the sensing unit 140 in response to the sensing voltage.

The timing controller 150 may control the operation of the scan driver 120, the data driver 130, and the sensing unit 140. The timing controller 150 may generate a scan driving control signal SCS, a data driving control signal DCS, a sensing control signal SSCS to respectively control the scan driver 120, the data driver 130, and the sensing unit 140.

In an exemplary embodiment of the present inventive concept, the timing controller 150 may correct input image data (e.g., first image data DATA1), taking into account gamma characteristics of the display device 100. For example, the timing controller 150 may perform a gamma correction for each of red image data, green image data, and blue image data that are included in the input image data. Thus, corrected red data, corrected green data, and corrected blue data may be generated based on the gamma correction of each of red image data, green image data, and blue image data. The gamma correction for input image data may be referred to as, for example, an adaptive color correction (ACC) process.

In an exemplary embodiment of the present inventive concept, the timing controller 150 may perform an ACC process for input image data, with reference to an ACC look-up table (hereinafter, referred to as, e.g., "ACC LUT") stored in the memory 160. For example, the timing controller 150 may load a gamma correction value corresponding to each of the red image data, the green image data, and the blue image data of the image data from the ACC LUT, and correct the image data using the loaded gamma correction value. However, the present inventive concept is not limited thereto. For example, in an exemplary embodiment of the present inventive concept, the timing controller 150 may perform the ACC process for the input image data through real-time calculation. For example, the timing controller 150 may perform the ACC process for the input image data when the input image data is received.

Furthermore, in an exemplary embodiment of the present inventive concept, the timing controller 150 may compensate for the gamma-corrected image data, based on the respective threshold voltages Vth of the pixels PX that have been measured by the sensing unit 140, and the timing controller 150 may provide the compensated image data (e.g., the second image data DATA2) to the data driver 130.

For example, the timing controller 150 may determine a gray-scale compensation level for the image data in response to the threshold voltages Vth of the pixels PX measured during the sensing period, and the timing controller 150 may determine a gray-scale compensation value corresponding to the gray-scale compensation level. For example, the timing controller 150 may determine the gray-scale compensation value based on a gamma correction value for the input image data DATA1. For example, the timing controller 150 may determine the gray-scale compensation value from the gray-scale compensation level by using the gamma correction value of the input image data DATA1 loaded from the ACC LUT.

An image data compensating method of the timing controller 150 will be described below with reference to FIGS. 3 and 6.

The memory 160 may store data needed to drive the display device 100. For example, the memory 160 may store the above-mentioned ACC LUT. The ACC LUT may be previously set during a process of manufacturing the display device 100 and stored in the memory 160, or may be received from an external host device or the like and stored in the memory 160.

Although FIG. 1 illustrates that the sensing unit 140 is a separate and independent component, the present inventive concept is not limited thereto. In an exemplary embodiment of the present inventive concept, the sensing unit 140 may be mounted in the data driver 130 or the timing controller 150, or may be integrally provided with the data driver 130 or the timing controller 150. In an exemplary embodiment of the present inventive concept, the data lines D1 to Dm may substitute for the sensing lines SS1 to SSm, so that the data lines D1 to Dm may be used as the sensing lines SS1 to SSm through a time sharing operation.

In addition, although the timing controller 150 will hereinafter be described as performing an image data correction according to an exemplary embodiment of the present inventive concept, the present inventive concept is not limited thereto. In an exemplary embodiment of the present inventive concept, for example, an image compensation unit, which is separately provided, may perform the image data correction, and may transmit compensated image data to the timing controller 150 or the data driver 130. For example, the compensated image data may be transmitted directly to the timing controller 150 or the data driver 130 from the image compensation unit.

Figure 2:
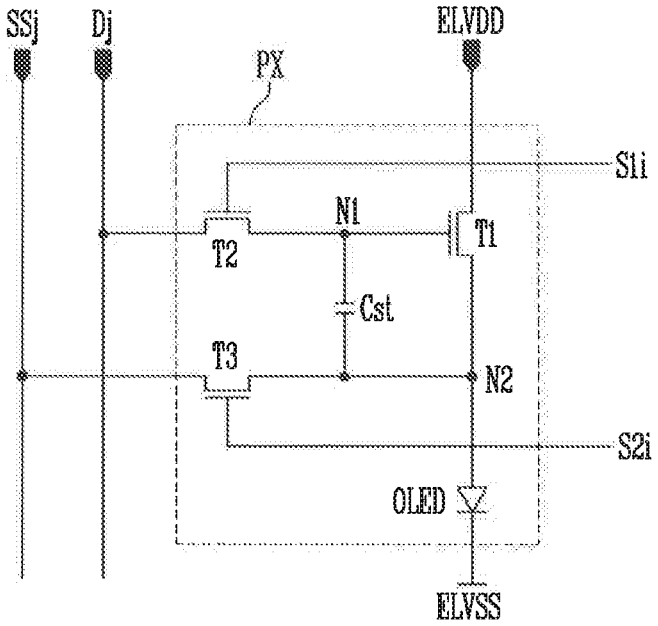
FIG. 2 is a circuit diagram of a pixel illustrated in FIG. 1.

FIG. 2 is a circuit diagram illustrating an example of a pixel PX illustrated in FIG. 1. FIG. 2 illustrates a pixel PX that is coupled to an i-th first scan line S1*i*, an i-th second scan line S2*i*, a j-th data line Dj, and a j-th sensing line SSj.

Referring to FIG. 2, the pixel PX may include first to third transistors T1 to T3, a storage capacitor Cst, and an organic light emitting diode OLED. The pixel PX may be coupled to the data driver 130 through the data line Dj and coupled to the sensing unit 140 through the sensing line SSj. Furthermore, the pixel PX may be coupled to the scan driver 120 through the first scan line S1*i* and the second scan line S2*i*.

An anode electrode of the organic light emitting diode OLED may be coupled to a second electrode (e.g., a second node N2) of the first transistor T1, and a cathode electrode of the organic light emitting diode OLED may be coupled to a second driving power supply ELVSS. The organic light emitting diode OLED may emit light having a predetermined luminance corresponding to current supplied from the first transistor T1.

A first electrode of the first transistor (e.g., a driving transistor) T1 may be coupled to a first driving power supply ELVDD, and the second electrode of the first transistor T1 may be coupled to the anode electrode (e.g., the second node N2) of the organic light-emitting diode OLED. A gate electrode of the first transistor T1 may be coupled to the first node N1. The first transistor T1 may control the amount of current flowing to the organic light emitting diode OLED in response to the voltage received from the first node N1.

A first electrode of the second transistor T2 may be coupled to the data line Dj, and a second electrode of the second transistor T2 is coupled to the first node N1. A gate electrode of the second transistor T2 may be coupled to the first scan line S1*i*. When a first scan signal is supplied to the first scan line S1*i*, the second transistor T2 may be turned on to transmit a voltage from the data line Dj to the first node N1.

In an exemplary embodiment of the present inventive concept, in synchronization with the first scan signal supplied during the display period, a data signal is supplied to the data line Dj. In synchronization with the first scan signal supplied during the sensing period, a sensing voltage may be supplied to the data line Dj.

The third transistor T3 may be coupled between the sensing line SSj and the first electrode (e.g., the second node N2) of the first transistor T1. A gate electrode of the third transistor T3 may be coupled to the second scan line S2*i*. When a second scan signal is supplied to the second scan line S2*i*, the third transistor T3 may be turned on to electrically connect the sensing line SSj with the second node N2.

In an exemplary embodiment of the present inventive concept, in synchronization with the second scan signal supplied during the display period, a reference voltage is supplied to the sensing line SSj. In synchronization with the second scan signal supplied during the sensing period, current or voltage may be supplied from the second node N2 to the sensing line SSj. The current or voltage supplied to the sensing line SSj during the sensing period may be transmitted to the sensing unit 140 and used to measure the characteristics of the pixel PX. For example, the characteristics of the pixel PX may include the threshold voltage Vth of the first transistor T1.

The storage capacitor Cst may be coupled between the first node N1 and the second node N2. The storage capacitor Cst may store a voltage corresponding to a difference in voltage between the first node N1 and the second node N2.

In an exemplary embodiment of the present inventive concept, the luminance of the pixel PX may be determined by the data signal. However, the characteristics of the first transistor T1 may be incorporated into the luminance of the pixel PX. For example, according to an exemplary embodiment of the present inventive concept, the characteristics of the first transistor T1 may be sensed during the sensing period, and a compensation operation of changing, based on the sensed characteristics, the image data (e.g., the first image data DATA1) to be displayed during the display period may be performed. In the present embodiment, an image having substantially consistent quality may be displayed regardless of a deviation in characteristics between the first transistors T1 of the pixels PX of the display panel 110.

For example, in an exemplary embodiment of the present inventive concept, in compensating the image data to be based on the characteristics of the first transistor T1, the gray scale of the image data may be compensated for in response to the gamma correction value. For example, in an exemplary embodiment of the present inventive concept, a gamma correction for the image data may be primarily performed, and gray-scale compensation for the image data based on the characteristics of the first transistor T1 may be secondarily performed in response to the gamma correction value. In an exemplary embodiment of the present inventive concept, the gamma correction may be performed with reference to the ACC LUT. Furthermore, the gray-scale compensation may be performed with reference to the characteristic value of the first transistor T1 and the gamma correction value used in the gamma correction. For example, the characteristic value of the first transistor T1 may be a threshold voltage of the first transistor T1.

The image data compensating method according to an exemplary embodiment of the present inventive concept will be described in more detail with reference to FIGS. 3 to 6.

In an exemplary embodiment of the present inventive concept, the sensing period, in which the characteristics of the pixels PX are measured, may be provided in a portion of a vertical blank period between display periods in which the display device 100 displays an image. Thereby, even if the characteristics of the first transistor (e.g., the driving transistor) T1 included in each of the pixels PX vary while the display device 100 is operated, the characteristic information of the pixels PX may be updated in real time and reflected in generation of a data signal. Hence, the display panel 110 may display an image having substantially uniform quality that is substantially consistent while the display device 100 is operated.

In an exemplary embodiment of the present inventive concept, the structure of the pixel PX and the driving method for sensing the characteristics of the pixel PX are not limited to those described above.

Although FIG. 2 illustrates an example of a pixel PX in which each of the first to third transistors T1 to T3 is an n-type transistor, the present inventive concept is not limited thereto. For example, in an exemplary embodiment of the present inventive concept, at least some or all of the first to third transistors T1 to T3 may be p-type transistors, and the circuit of the pixel PX illustrated in FIG. 2 may be correspondingly modified in various ways.

Figure 3:
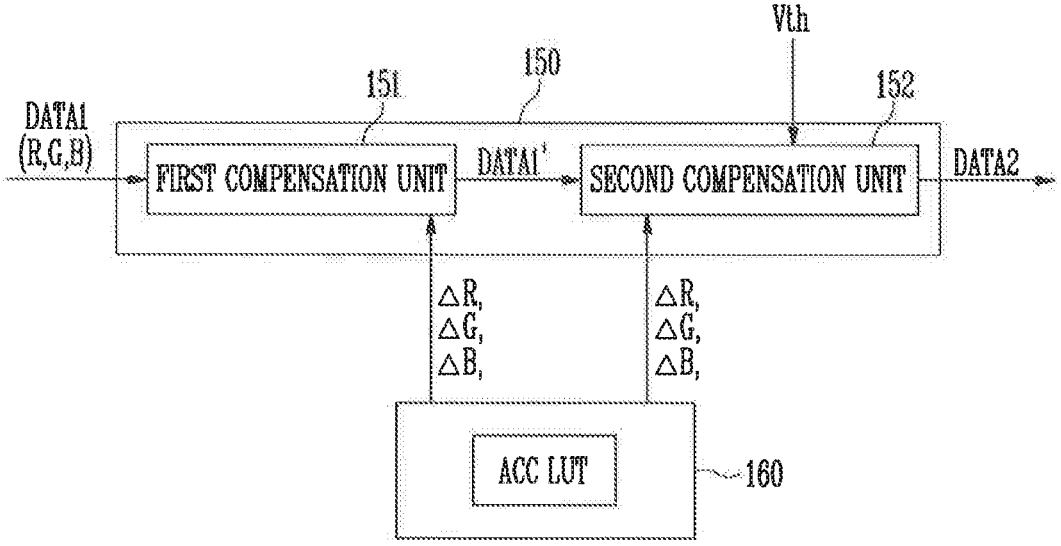
FIG. 3 is a block diagram illustrating a timing controller of FIG. 1.
Figure 4:
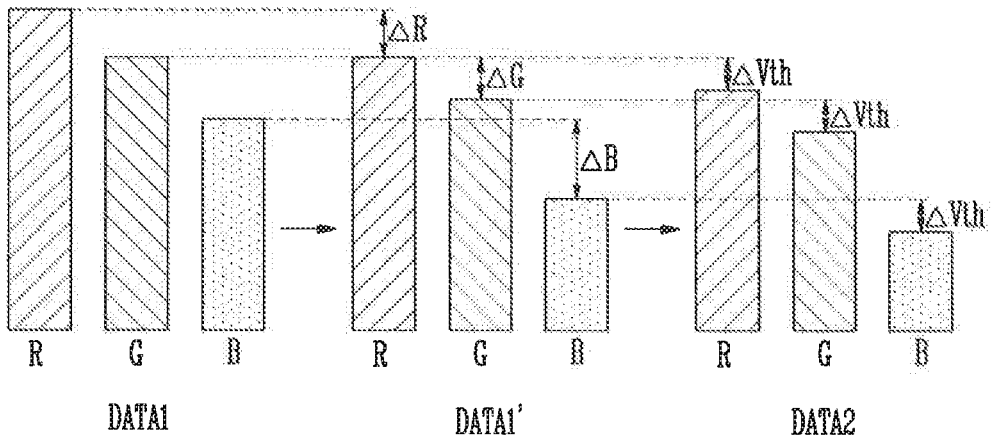
FIGS. 4 and 5 are diagrams for describing compensation for image data by the timing controller in accordance with an exemplary embodiment of the present inventive concept.
Figure 5:
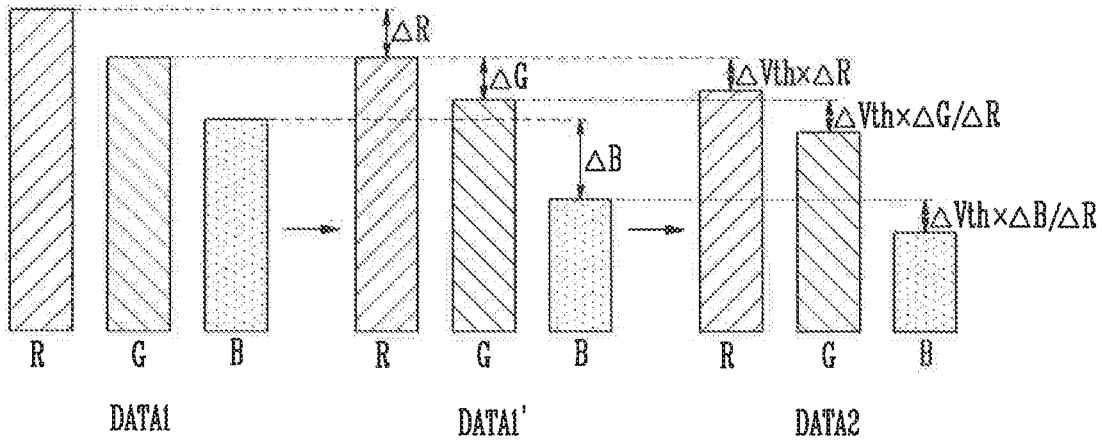

FIG. 3 is a block diagram illustrating the timing controller 150 of FIG. 1 according to an exemplary embodiment of the present inventive concept. FIGS. 4 and 5 are diagrams for describing compensation for image data by the timing controller 150 in accordance with an exemplary embodiment of the present inventive concept.

Referring to FIG. 3, the timing controller 150 in accordance with an exemplary embodiment of the present inventive concept may include a first correction unit 151 and a second correction unit 152.

The first correction unit 151 may receive first image data DATA1 from the external host device or the like. In the present exemplary embodiment, the first image data DATA1 may include red image data R, green image data G, and blue image data B.

The first correction unit 151 may perform gamma correction, e.g., an ACC process, for the first image data DATA1. For example, the first correction unit 151 may determine respective gamma correction values for the red image data R, the green image data G, and the blue image data B according to the gamma characteristics of the display device 100, and correct the first image data DATA1 by applying the determined gamma correction values, respectively, to the red image data R, the green image data G, and the blue image data B.

For example, the first correction unit 151 may correct the first image data DATA1 by adding or subtracting the determined corresponding gamma correction value to or from the first image data DATA1 or by multiplying first image data DATA1 by the corresponding gamma correction value. In addition, the first correction unit 151 may correct the first image data DATA1 by applying the determined gamma correction value and the first image data DATA1 to a predetermined operation formula.

In an exemplary embodiment of the present inventive concept, the first correction unit 151 may perform the ACC process for the first image data DATA1 with reference to the ACC LUT stored in the memory 160. The ACC LUT may include information obtained by one-to-one mapping of gamma correction values to image data, while taking into account the gamma characteristics of the display device 100. For example, the ACC LUT may include red gamma correction values ΔR corresponding to red image data R, green image data G, and blue image data B, green gamma correction values ΔG corresponding to red image data R, green image data G, and blue image data B, and blue gamma correction values ΔB corresponding to red image data R, green image data G, and blue image data B. For example, the ACC LUT may be previously set during a process of manufacturing the display device 100, or may be received from the external host device or the like and stored in the memory 160.

The first correction unit 151 may load, from the ACC LUT, a red gamma correction value ΔR, a green gamma correction value ΔG, and/or a blue gamma correction value ΔB, each of which corresponds to red image data R, green image data G, and blue image data B of the first image data DATA1. Furthermore, the first correction unit 151 may apply the loaded gamma correction values ΔR, ΔG, and ΔB, respectively, to the red image data R, the green image data G, and the blue image data B of the first image data DATA1, and thus ACC-processed first image data DATA1 is generated. Here, the gamma correction values ΔR, ΔG, and ΔB may be applied to the image data by respectively adding or subtracting the gamma correction values ΔR, ΔG, and ΔB to or from the red image data R, the green image data G, and the blue image data B or by respectively multiplying the red image data R, the green image data G, and the blue image data B by the gamma correction values ΔR, ΔG, and ΔB.

However, in the present inventive concept, the ACC process of the first image data DATA1 is not limited to being based on the ACC LUT. In an exemplary embodiment of the present inventive concept, the ACC LUT may be replaced with different types of calculators and processors configured to determine gamma correction values.

The second correction unit 152 may receive the ACC-processed first image data DATA1' from the first correction unit 151. The second correction unit 152 may apply characteristic compensation of the driving transistor to the ACC-processed first image data DATA1'.

For example, the second correction unit 152 may determine a gray-scale compensation level for the ACC-processed first image data DATA1' in response to the threshold voltages Vth of the driving transistors of the respective pixels PX that are measured by the sensing unit 140. The gray-scale compensation level may be determined based on a change between the reference threshold voltage of the driving transistor and the measured threshold voltage Vth. For example, the gray-scale compensation level may be the change itself between the reference threshold voltage and the measured threshold voltage, or may be determined by a preset value corresponding to the change. According to an exemplary embodiment of the present inventive concept, the gray-scale compensation level may be determined using a separate LUT or the like obtained by one-to-one mapping of gray-scale compensation levels to threshold voltages Vth of the driving transistor. However, the present inventive concept is not limited thereto.

In an exemplary embodiment of present the inventive concept, the second correction unit 152 may determine the gray-scale compensation level, based on a threshold voltage Vth of a pixel PX of a specific color (hereinafter, referred to as a reference color) among the threshold voltages Vth of the pixels PX that are measured by the sensing unit 140. For example, the second correction unit 152 may determine the gray-scale compensation level of the first image data DATA1, based on the threshold voltage Vth of a pixel PX that represents red.

In this exemplary embodiment, the second correction unit 152 may determine the gray-scale compensation value from the gray-scale compensation level with reference to the ACC LUT. For example, the second correction unit 152 may obtain a red gamma correction value ΔR, a green gamma correction value ΔG, and a blue gamma correction value ΔB for the first image data DATA1 from the ACC LUT. The second correction unit 152 may determine a ratio between a gamma correction value for the reference color and a gamma correction value for each of the other colors.

The second correction unit 152 may determine the predetermined gray-scale compensation level to be a gray-scale compensation value of the reference color. Furthermore, the second correction unit 152 may reflect a ratio of the gamma correction value of the reference color to a gamma correction value of each of the other colors in the predetermined gray-scale compensation level, and thus a gray-scale compensation value for each of the other colors is determined. For example, the ratio of the gamma correction value of the reference color to a gamma correction value of each of the other colors may be applied to the predetermined gray-scale compensation level to determine the gray-scale compensation value for the remaining colors.

For example, in an exemplary embodiment of the present inventive concept, the second correction unit 152 may determine the predetermined gray-scale compensation level to be a red gray-scale compensation value. The second correction unit 152 may determine a ratio of the green gamma correction value ΔG to the red gamma correction value ΔR (ΔG/ΔR, e.g., a first ratio), and a ratio of the blue gamma correction value ΔB to the red gamma correction value ΔR (ΔB/ΔR, e.g., a second ratio). The second correction unit 152 may determine a green gray-scale compensation value by applying the first ratio to the predetermined gray-scale compensation level, and may determine a blue gray-scale compensation value by applying the second ratio to the predetermined gray-scale compensation level.

The second correction unit 152 may apply the determined red gray-scale compensation value, green gray-scale compensation value, and blue gray-scale compensation value to the ACC-processed first image data DATA1', and thus the ACC-processed first image data DATA1' may be corrected. For example, the second correction unit 152 may add or subtract the determined red gray-scale compensation value, green gray-scale compensation value, and/or blue gray-scale compensation value to or from the ACC-processed first image data DATA1', or may multiply the ACC-processed first image data DATA1' by the determined red gray-scale compensation value, green gray-scale compensation value, and/or blue gray-scale compensation value, and thus the image data may be corrected. The second correction unit 152 may output the corrected image data as second image data DATA2.

As illustrated in FIG. 4, in the case where gray-scale compensation using a threshold voltage change of red, green, or blue is performed, if a gray-scale level for a specific color is determined, the determined gray-scale compensation level is applied to red, green, and blue image data in a substantially uniform way. In this case, since a ratio between RGB changes after threshold voltage compensation by an ACC, colors may not be accurately represented.

In the present inventive concept, since gray-scale compensation levels determined with reference to the ACC LUT are applied to red, green, and blue image data, as illustrated in FIG. 5, a ratio between the respective color image data, before the gray-scale compensation is performed, may remain the same even after the gray-scale compensation. In addition, in the present inventive concept, the mixing ratio of RGB may remain the same even after the gray-scale compensation is performed based on threshold voltages, whereby a predetermined luminance and gray-scale may be properly represented without color smudge.

Figure 6:
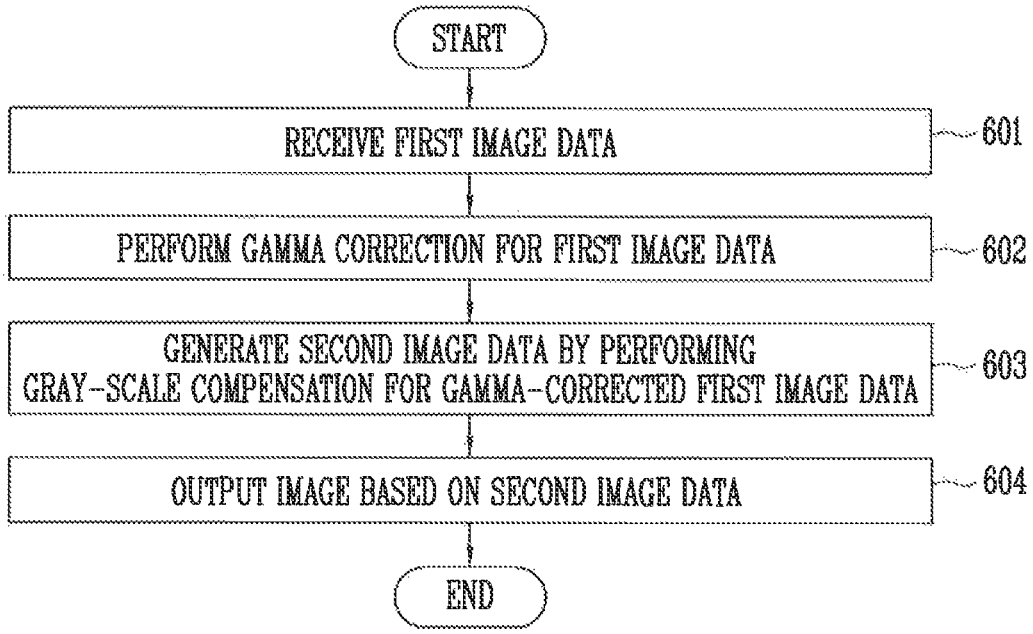
FIG. 6 is a flowchart illustrating a method of driving the display device in accordance with an exemplary embodiment of the present inventive concept.

FIG. 6 is a flowchart illustrating a method of driving the display device 100 in accordance with an exemplary embodiment of the present inventive concept.

Referring to FIG. 6, the display device 100 in accordance with an exemplary embodiment of the present inventive concept may receive first image data from the external host device or the like (at step 601). The first image data may include, for example, red image data, green image data, and blue image data.

In addition, the display device 100 may perform a gamma correction for the first image data (at step 602). For example, the display device 100 may respectively load, from the pre-stored ACC LUT, a red gamma correction value, a green gamma correction value, and a blue gamma correction value for the red image data, the green image data, and the green image data of the first image data. The display device 100 may generate gamma-corrected first image data by applying the obtained gamma correction value to the first image data.

Furthermore, the display device 100 may generate second image data by performing gray-scale compensation for the gamma-corrected first image data (at step 603). The display device 100 may perform the gray-scale compensation for the gamma-corrected first image data, while taking into account the characteristics of the driving transistors of pixels PX.

For example, the display device 100 may measure the threshold voltage of a pixel PX that represents a reference color. Although the reference color may be, for example, red, the present inventive concept is not limited thereto.

The display device 100 may compare the measure threshold voltage with the reference threshold voltage, and thus a gray-scale compensation level for the first image data may be determined. Furthermore, the display device 100 may determine a gray-scale compensation value for the first image data from the gray-scale compensation level, based on the gamma correction value of the first image data.

For example, the display device 100 may obtain the red gamma correction value, the green gamma correction value, and/or the blue gamma correction value of the first image data that have been used at the above-mentioned gamma correction step. The display device 100 may determine a ratio of a gamma-correct value of each of the other colors to the gamma correction value of the reference color.

The display device 100 may determine the determined gray-scale compensation level to be the gray-scale compensation value of the reference color. Furthermore, the display device 100 may apply the above-determined gamma correction value to the determined gray-scale compensation level, and thus gray-scale compensation values of other colors except the reference color may be determined.

The display device 100 may generate second image data by applying the determined gray-scale compensation value to the gamma-corrected first image data.

The display device 100 may output an image based on the second image data (at step 604). When the image is output using the second image data, the display device 100 may accurately represent the image having a predetermined gray scale through the gamma-correction and the threshold voltage compensation, without a color smudge.

As described above, in a display device and a method of driving the display device in accordance with an exemplary embodiment of the present inventive concept, threshold voltage compensation for an image signal may be performed without a change in color.

In addition, exemplary embodiments of the present inventive concept are directed to a display device configured to perform the threshold voltage compensation for the image data using an adaptive color correction look-up table (ACC LUT), and a method of driving the display device.

In the display device and the method of driving the display device in accordance with an exemplary embodiment of the present inventive concept, a spot of the display device may be effectively removed, whereby color distortion may be prevented by the spot removal.

As is traditional in the field of the present inventive concept, exemplary embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the exemplary embodiments of the present inventive concept may be physically separated into two or more interacting and discrete blocks, units and/or modules without departing from the scope of the present inventive concept. Further, the blocks, units and/or modules of the exemplary embodiments of the present inventive concept may be physically combined into more complex blocks, units and/or modules without departing from the scope of the present inventive concept.

While the present inventive concept has been particularly shown and described with reference to exemplary embodiments thereof, it will be apparent those of ordinary skill in the art that various changes in form and detail may be made thereto without departing from spirit and scope of the present inventive concept.

What is claimed is:

1. A display device comprising:

a display panel including a plurality of pixels;

a first correction circuit configured to perform, using a gamma correction value, a gamma correction for first image data, wherein the first correction circuit obtains the gamma correction value from a memory, and performs the gamma correction by applying the gamma correction value to the first image data;

a second correction circuit configured to receive the gamma-corrected first image, and to generate second image data by performing gray-scale compensation for the gamma-corrected first image data; and a data driver configured to provide a data signal corresponding to the second image data to the plurality of pixels, wherein the second correction circuit performs the gray-scale compensation based on the gamma correction value and a threshold value measured for each of the plurality of pixels, wherein the second correction circuit receives the gamma correction value from the memory.

2. The display device of claim 1, wherein the gamma correction value corresponds to the first image data.

3. The display device of claim 2, wherein the second correction circuit determines a gray-scale compensation level for the first image data based on the measured threshold value, determines a gray-scale compensation value for the first image data by applying the gamma correction value to the determined gray-scale compensation level, and generates the second image data by applying the determined gray-scale compensation value to the gamma-corrected first image data.

4. The display device of claim 3, wherein the second correction circuit determines the gray-scale compensation level based on the measured threshold value of a pixel that corresponds to a first color, and determines the determined gray-scale compensation level to be a gray-scale compensation value of image data for the first color.

5. The display device of claim 4, wherein the gamma correction value includes a gamma correction value of the first color and a gamma correction value of a second color, wherein the second correction circuit determines a ratio of the gamma correction value of the second color to the gamma correction value of the first color, and determines a gray-scale compensation value of the second color by applying the determined ratio to the gray-scaly compensation level.

6. The display device of claim 2, wherein the first correction circuit obtains the gamma correction value from a pre-stored look-up table.

7. The display device of claim 1, wherein the threshold value comprises a threshold voltage, and the second correction circuit determines a gray-scale compensation level for the first image data in response to a threshold voltage of a first pixel of the plurality of pixels to determine a gray-scale compensation value for the first image data, wherein the second image data is generated based on the gray-scale compensation value for the first image.

8. A method of driving a display device including a plurality of pixels, the method comprising:

performing, using a gamma correction value, a gamma correction for first image data;

generating second image data by performing gray-scale compensation for the gamma-corrected first image data; and outputting an image corresponding to the second image data, wherein the generating of the second image data comprises:

determining a gray-scale compensation value based on the gamma correction value and a gray-scale compensation level for the first image data based on a threshold voltage measured for each of the plurality of pixels; and generating the second image data by applying the gray-scale compensation value to the gamma-corrected first image data.

9. The method of claim 8, wherein the performing of the gamma-correction for the first image data comprises:

obtaining the gamma correction value from a memory, wherein the gamma correction value corresponds to the first image data; and applying the gamma-correction value to the first image data.

10. The method of claim 9, wherein the generating of the second image data comprises:

determining the gray-scale compensation level for the first image data based on the measured threshold voltage;

determining the gray-scale compensation value for the first image data by applying the gamma correction value to the determined gray-scale compensation level; and generating the second image data by applying the determined gray-scale compensation value to the gamma-corrected first image data.

11. The method of claim 10, wherein the determining of the gray-scale compensation level comprises determining the gray-scale compensation level based on the measured threshold voltage of a pixel that corresponds to a first color, and wherein the determining of the gray-scale compensation value comprises determining the determined gray-scale compensation level to be a gray-scale compensation value of image data for the first color.

12. The method of claim 11, wherein the gamma correction value includes a gamma correction value of the first color and a gamma correction value of a second color, and wherein the determining of the gray-scale compensation value comprises:

determining a ratio of the gamma correction value of the second color to the gamma correction value of the first color; and determining a gray-scale compensation value for the second color by applying the determined ratio to the gray-scale compensation level.

13. The method of claim 9, wherein the obtaining of the pre-stored gamma correction value comprises loading the gamma correction value corresponding to the first image data from a pre-stored look-up table.

14. The method of claim 10, wherein the determining of the gray-scale compensation level comprises determining the gray-scale compensation level based on a change between a reference threshold voltage of a pixel and the measured threshold voltage of the pixel.

15. A display device comprising:

a display panel including a plurality of pixels;

a first correction circuit configured to perform, using a gamma correction value, a gamma correction for first image data, wherein the gamma correction value corresponds to the first image data and is obtained from a memory;

a second correction circuit configured to receive the gamma-corrected first image, and to generate second image data by applying a gray-scale compensation value, for the first image data, to the gamma-corrected first image, wherein the gray-scale compensation value is determined by applying the gamma correction value, corresponding to the first image data, to a gray-scale compensation level for the first image data; and a data driver configured to provide a data signal corresponding to the second image data to the plurality of pixels, wherein the second correction circuit determines the gray-scale compensation level for the first image data in response to a measured threshold voltage of a first pixel of the plurality of pixels.

16. The display device of claim 15, wherein the gray-scale compensation level for the first image data is determined based on a change between a reference threshold voltage of the first pixel and the measured threshold voltage of the first pixel.

17. The display device of claim 15, wherein the first pixel corresponds to a first color, wherein the gamma correction value includes a gamma correction value of the first color and a gamma correction value of a second color, and wherein the second correction circuit determines the determined gray-scale compensation level for the first image data to be a gray-scale compensation value of the first image data for the first color, and determines a gray-scale compensation value for the second color by applying a predetermined ratio to the gray-scale compensation level for the first image data, wherein the predetermined ratio is of the gamma correction value of the second color to the gamma correction value for the first color.

18. The display device of claim 15, wherein the first image data is received from an external circuit.

* * * * *